US009988808B2

(12) United States Patent
Rahimzadeh et al.

(10) Patent No.: US 9,988,808 B2
(45) Date of Patent: Jun. 5, 2018

(54) BUILDING STRUCTURE

(75) Inventors: Housh Rahimzadeh, Alpharetta, GA (US); Marc Rahimzadeh, Alpharetta, GA (US)

(73) Assignee: DIVERSAKORE LLC, Alpharetta, GA (US)

( * ) Notice: Subject to any disclaimer, the term of this patent is extended or adjusted under 35 U.S.C. 154(b) by 1726 days.

(21) Appl. No.: 13/383,015

(22) PCT Filed: Jul. 8, 2010

(86) PCT No.: PCT/US2010/041381

§ 371 (c)(1),
(2), (4) Date: Feb. 1, 2016

(87) PCT Pub. No.: WO2011/005970

PCT Pub. Date: Jan. 13, 2011

(65) Prior Publication Data

US 2016/0130798 A1 May 12, 2016

Related U.S. Application Data

(60) Provisional application No. 61/223,763, filed on Jul. 8, 2009.

(51) Int. Cl.

| | |
|---|---|
| ***E04B 1/04*** | (2006.01) |
| ***E04B 1/41*** | (2006.01) |
| ***E04B 1/24*** | (2006.01) |
| ***E04B 5/04*** | (2006.01) |
| ***E04B 5/12*** | (2006.01) |
| ***E04B 5/29*** | (2006.01) |

(Continued)

(52) U.S. Cl.

CPC ..... *E04B 1/4114* (2013.01); *E04B 1/24* (2013.01); *E04B 5/023* (2013.01); *E04B 5/043* (2013.01); *E04B 5/12* (2013.01); *E04B 5/29* (2013.01); *E04B 5/40* (2013.01); *E04B 2001/2454* (2013.01); *E04B 2001/2484* (2013.01)

(58) Field of Classification Search

CPC ..... E04B 1/043; E04B 1/046

See application file for complete search history.

(56) References Cited

U.S. PATENT DOCUMENTS 1,060,853 A * 5/1913 Peirce ..... E04B 1/185 256/19
1,624,802 A * 4/1927 Rebell ..... A47B 79/00 52/259

(Continued)

FOREIGN PATENT DOCUMENTS

DE 2431424 A1 * 1/1976 ..... E04B 1/046

OTHER PUBLICATIONS

International Search Report and Written Opinion in corresponding application No. PCT/US2010/041381.

*Primary Examiner* — Elizabeth A Quast
(74) *Attorney, Agent, or Firm* — Parks IP Law LLC

(57) ABSTRACT

A building structure includes elements that are integrally connected by a poured bonding structure. The elements include a beam having a cavity that is configured to receive a pourable bonding material and flooring sections that are supported by the beams. The flooring sections include voids that open to a cavity. Inserts are positioned in the voids to control the limit the depth that the pourable bonding material can flow into the voids and to increase the strength of the poured bonding structure.

20 Claims, 6 Drawing Sheets

(51) Int. Cl.
*E04B 5/40* (2006.01)
*E04B 5/02* (2006.01)

(56) References Cited

U.S. PATENT DOCUMENTS

| | | | | |
|---|---|---|---|---|
| 3,821,869 | A | 7/1974 | Morgan | |
| 4,398,378 | A | 8/1983 | Heitzman | |
| 4,982,538 | A * | 1/1991 | Horstketter | B28B 23/00 52/236.8 |
| 5,671,582 | A * | 9/1997 | Reay | E04B 1/164 52/259 |
| 5,878,546 | A | 3/1999 | Westover | |
| 6,295,770 | B1 * | 10/2001 | Sheu | E04B 1/161 52/167.1 |
| 6,793,436 | B1 * | 9/2004 | Ruel | E02D 29/0241 403/208 |
| 7,010,891 | B1 * | 3/2006 | Clark | B28B 15/005 52/125.5 |
| 8,056,291 | B1 * | 11/2011 | diGirolamo | E04B 5/19 52/250 |
| 9,617,724 | B2 * | 4/2017 | Lubberts | E04B 1/043 |
| 2002/0069602 | A1 | 6/2002 | Blanchet | |
| 2006/0059841 | A1 | 3/2006 | Bennett | |
| 2013/0074430 | A1 * | 3/2013 | Morcous | E04B 5/16 52/252 |

* cited by examiner 79
80
60
64
16
16
66

16
79
80
60
64
66

16
164
170
162
60
166
168

16
170
162
60
166
168
164

BUILDING STRUCTURE

CROSS REFERENCE TO RELATED APPLICATION

This application claims priority to U.S. Provisional Application No. 61/223,763, filed Jul. 8, 2009, the entirety of which is herein incorporated by reference.

TECHNICAL FIELD

This disclosure relates generally to building construction and, more specifically, to a building structure and a method for forming thereof.

BACKGROUND

Hollow core slabs or voided slabs are prefabricated slabs of prestressed concrete that are typically used in the construction of floors in multi-story buildings. Hollow core slabs typically have tubular voids extending the length of the slab. Generally, the structure of the slab that is located between the voids includes steel rods that provide the majority of the tensile stress that holds the slab together. However, in certain applications, this structure does not provide the necessary shear capacity at bearing ends. In addition, in certain applications, the tubular voids are partially filled with a pourable bonding material. It can be difficult to control the amount of pourable bonding material that flows into the tubular voids and the slabs may still not provide the necessary shear capacity.

SUMMARY

The various embodiments of the present disclosure provide a building structure having a poured bonding structure that integrally connects columns, beams, and flooring sections. The building structure includes elements that are quickly erected and then integrally connected with a poured bonding structure. The flooring sections include voids and the voids can be filled with pourable bonding material to facilitate integrating the flooring section with the other elements of the building structure. Inserts are positioned in the voids to limit the amount of material that is permitted to enter the voids. The inserts include a structure that facilitates positioning the inserts in the voids such that the amount of material permitted to enter the voids can be optimized. The inserts also include a structure that reinforces the strength of the pourable bonding material that is in and around the void.

According to an exemplary embodiment, a framing structure includes a beam and a flooring section that is supported by the beam. The beam and a supported end of the flooring section define a cavity. The flooring section includes voids that open to the cavity. A structural plate is positioned at a distance from the open end of the void and is configured to be adjustable along the length of the void. A bar extends from the plate toward and into the cavity.

The foregoing has broadly outlined some of the aspects and features of the present disclosure, which should be construed to be merely illustrative of various potential applications. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

DETAILED DESCRIPTION

As required, detailed embodiments are disclosed herein. It must be understood that the disclosed embodiments are merely exemplary and that the present disclosure may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present disclosure. Therefore, specific structural and functional details disclosed herein are not to be interpreted as limiting, but merely as a basis for the claims and as a representative basis for teaching one skilled in the art.

In general, the exemplary building structures described herein include voided flooring sections and inserts that are configured to be positioned in the voids to control the flow of a pourable bonding material through the voids. Each of the inserts includes a first structure that at least partially closes the path of or partitions the void. Each of the inserts can also include a second structure for use as a handle to facilitate positioning the first structure and/or for use as a reinforcing structure to strengthen a poured bonding structure that is formed around the handle.

A first structure of the insert can include a stop, a plug, a plate, a series of plates, a wire-frame mesh structure, an inflatable structure, a ball, a malleable structure, a moldable structure, a rigid structure, combinations thereof, and the like. The material used to form the first structure can include metal, plastic, composites, cloth, wire, mesh, combinations thereof, and the like.

A second structure of the insert can include a handle bar, a rod, an anchor, a deformed bar, a formed section of bar, a mesh extension, combinations thereof, and the like. The material used to form the second structure can include metal, plastic, composites, combinations thereof and the like.

The selection of structure and material can be determined, for example, based on the needs and budget of a user. High strength materials can be selected where the user desires that the insert reinforces a poured bonding structure in and around the void. Low cost materials can be used where the user wants to limit the depth that pourable bonding material can flow into the void and reinforcing the poured bonding structure is less important.

Figure 1:
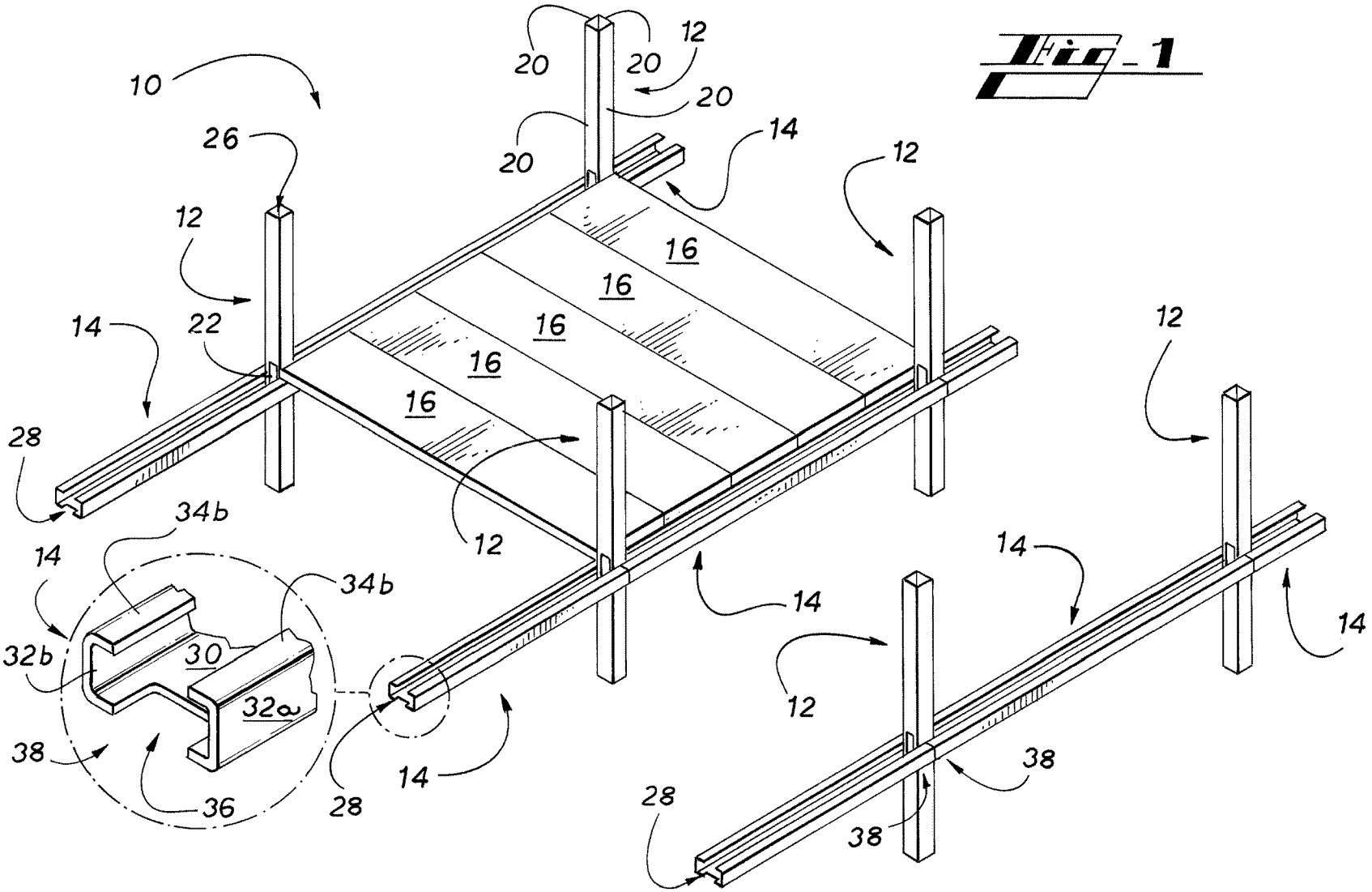
FIG. 1 is a partial perspective view of a building structure according to a first exemplary embodiment.
Figure 3:
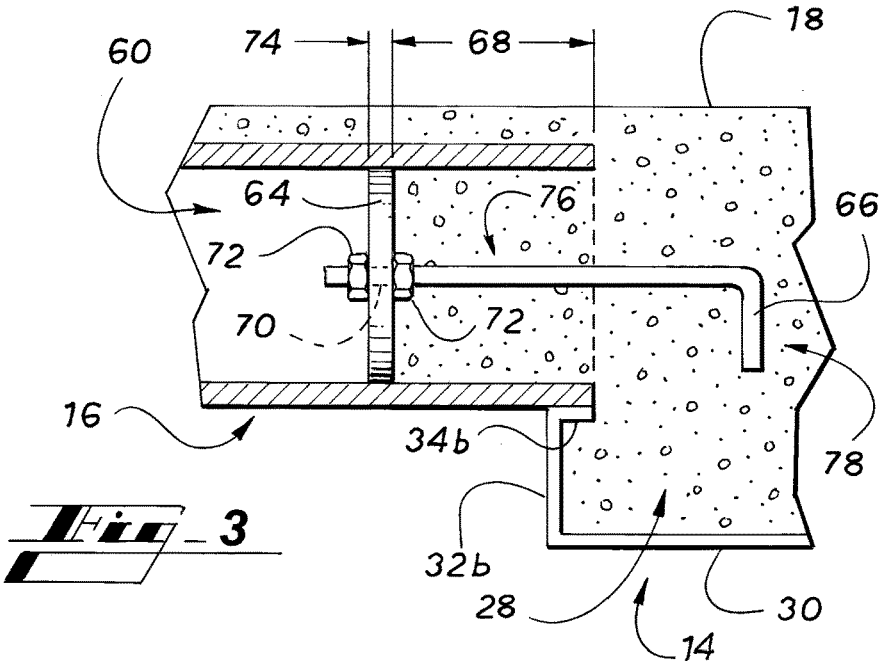
FIG. 3 is a cross sectional side elevation view of the building structure of FIG. 1.

Referring to FIG. 1, a first exemplary embodiment of a building structure 10 includes a plurality of columns 12, a plurality of beams 14, a plurality of flooring sections 16, and a poured bonding structure 18 (shown in FIG. 3). The exemplary columns 12, beams 14, and flooring sections 16 can be formed from material or materials that have characteristics which meet minimum performance requirements including steel, aluminum, wood, pre-cast concrete, composite materials, combinations thereof, and the like.

The illustrated columns 12 and beams 14 have steel walls that are configured to receive pourable bonding material to form composite structures. The illustrated columns 12 and beams 14 are used to form the sheath of composite columns and beams that include a core formed from a pourable bonding material.

The illustrated flooring sections 16 are hollow-core or voided slabs or planks that are prefabricated and made of prestressed concrete. It is contemplated that, in alternative embodiments, the flooring sections can include metal deck sections, wood planks, pre-cast concrete planks, poured-in-place structures, double T planks, single T planks, post-tensioned pre-cast sections, pan-formed sub flooring, composite structures, combinations thereof, and the like.

The illustrated poured bonding structure 18 (FIG. 3) is a pourable bonding material 18 that has solidified. As used herein, the term "bonding" is used to include materials that can form structures that link, connect, form a union between, or attach multiple structures to form a composite structure. As used herein, the term "pourable" in reference to bonding material is used to include bonding material that is in a moldable or substantially fluid state such that the material conforms to the shape of the container in which it is poured. The term "poured bonding structure" is used to include bonding material in a substantially rigid state or pourable bonding material that has solidified into a substantially rigid structure. These terms are used for purposes of teaching and in a non-limiting manner. Such bonding materials can include concrete, plasticized materials, cementitious materials, cement, grout, Gypcrete®, combinations thereof, and the like.

Continuing with FIG. 1, the beams 14 extend in a longitudinal direction and the ends thereof are supported by columns 12 at a height that corresponds to a floor or level of the building structure 10. Flooring sections 16 extend in a transverse direction and the ends thereof are supported by beams 14. The flooring sections 16 define a base layer of a floor of the building structure 10. As will be described in further detail below, the poured bonding structure 18 integrates the columns 12, the beams 14, and the flooring sections 16 such that the building structure 10 is substantially unitary.

Elements of the building structure 10 are described in further detail. The illustrated building structure 10 is formed from pluralities of like-numbered elements that are substantially similar. Although only a representative one or representative ones of the like-numbered elements may be described in detail, this description is generally applicable to each of the other like-numbered elements. Numbers alone are used to generally reference one of like-numbered elements or a group of like-numbered elements and suffixes such as "a" or "b" are attached to the numbers in order to reference individual ones of the like-numbered elements.

Referring to FIG. 1, the illustrated column 12 is a hollow-interior, box-style beam having a substantially square cross-section defined by four walls 20. The column 12 includes openings 22 that are disposed in certain of the walls 20 so as to provide a passageway between the exterior and the interior 26 of the column 12. The size, shape, and number of openings 22 are determined so as to allow a pourable bonding material 18 to flow through the openings 22 without substantially adversely affecting the structural integrity of the column 12.

The illustrated openings 22 are disposed in the column 12 at positions that generally correspond to where the ends of beams 14 substantially meet the column 12. In other words, the openings 22 are positioned to generally correspond to the floors or levels of the building structure 10. The columns 12 and the beams 14 are positioned with respect to one another such that the openings 22 of the columns 12 substantially align with cavities 28 of the beams 14.

Figure 2:
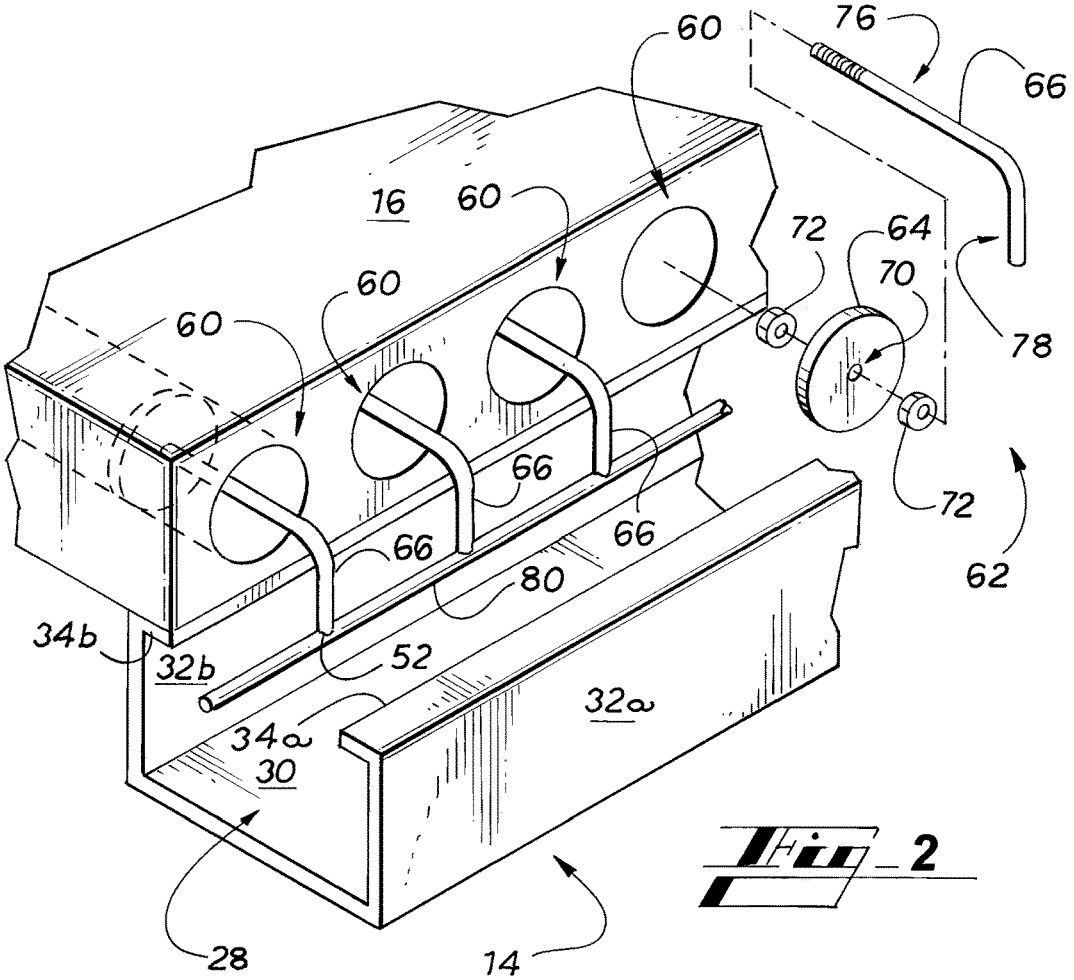
FIG. 2 is an exploded partial perspective view of a flooring section of the building structure of FIG. 1.

Referring to FIGS. 2 and 3, the beam 14 has a trough-like or channel-like structure in that the upward facing cavity 28 functions to receive and retain pourable materials. The exemplary beam 14 has a squared, U-shaped cross-section, although in alternative embodiments the cross-section of the beam 14 can be V-shaped, rounded U-shaped, H-shaped, and any other shape that provides the functionality described herein.

The beam 14 includes a base wall 30 and side walls 32*a*, 32*b* that extend vertically upward from the base wall 30 so as to define the cavity 28. Cantilevers 34*a*, 34*b* extend inwardly from the upper ends of the side walls 32*a*, 32*b* to provide a surface for supporting flooring sections 16, as described in further detail below. Alternatively, the cantilevers 34*a*, 34*b* can be arranged to extend outwardly from the sidewalls 32, one cantilever can extend inwardly and the other outwardly, or cantilevers can extend both inwardly and outwardly.

Referring to FIG. 1, a cutout 36 is defined in the base wall 30 at each of the ends 38 of the beam 14. The cutout 36 is dimensioned with respect to the column 12 such that the column 12 can be received in the cutout 36. Accordingly, in the illustrated embodiment, the cutout 36 is squared to correspond to the squared cross-section of the column 12. The depth of the illustrated cutout 36 is substantially equal to half of the depth of the column 12 and the width of the illustrated cutout 36 is substantially equal to the width of the column 12. Thus, when the column 12 is received in the cutouts 36 of abutting beams 14, the ends 38 of the beams 14 substantially abut one another to, in effect, provide a continuous beam 14.

Referring again to FIGS. 2 and 3, the illustrated flooring sections 16 are pre-cast concrete planks that include internal tubular voids 60. The tubular voids 60 facilitate integration of the flooring sections 16 with the other elements of the building structure 10, as described in further detail below. Each illustrated flooring section 16 is arranged such that open ends of the tubular voids 60 are located in the end of the flooring section 16 that is supported by the beam 14. The supported end of the flooring section 16 also partially defines the cavity 28, and the tubular voids 60 open to the cavity 28 such that the cavity 28 and the tubular voids 60 are a continuous volume. Flooring sections 16 increase the depth of the cavity 28.

The illustrated tubular voids 60 are configured to receive inserts 62. In alternative embodiments, the flooring sections 16 can include other features for receiving inserts including partial voids, depressions, recesses, and the like.

In the illustrated embodiment, inserts 62 are configured to be received in the tubular voids 60. The illustrated insert 62 includes a structural plate 64 and a reinforcing rod 66 that are connected to one another. The illustrated structural plate 64 includes an aperture 70 and the reinforcing rod 66 is threaded. The reinforcing rod 66 is inserted through the aperture 70 and threaded through bolts 72 on opposed sides of the structural plate 64. The bolts 72 are configured to tighten against the structural plate 64 to rigidly connect the reinforcing rod 66 and the structural plate 64. Alternatively, the structural plate 64 and the reinforcing rod 66 can be welded to one another, adhered to one another, pinned to one another, chemically affixed to one another, mechanically connected to one another, combinations thereof, and the like.

The structural plate 64 can be positioned within the tubular void 60 at different distances 68 from the open end of the tubular void 60 to adjust the depth which pourable bonding material 18 is permitted to flow into the tubular void 60. The shape and dimensions of the illustrated structural plate 64 is substantially that of the cross section of the tubular void 60 such that the structural plate 64 substantially partitions or closes the tubular void 60. The shape of each of the illustrated structural plates 64 and the cross section of each of the illustrated tubular voids 60 is circular. Alternative shapes include ovals, squares, rectangles, combinations thereof, and the like. The thickness 74 of the illustrated structural plate 64 is selected such that the structural plate 64 does not rotate in the tubular void 60, for example, as a force that creates a moment is applied to the reinforcing rod 66. The movement of the structural plate 64 is substantially limited to translation in the tubular void 60. The thickness 74 may be increased to account for a situation where the dimensions of the structural plate 64 are not substantially tightly toleranced with respect to the tubular void 60.

The illustrated reinforcing rod 66 is configured to facilitate positioning the structural plate 64 in the tubular void 60, to increase the strength of the poured bonding structure 18 both in the tubular void 60 and in the cavity 28, and to distribute forces on the poured bonding structure 18 in the tubular void 60 to the poured bonding structure 18 in the beam 14.

The illustrated reinforcing rod 66 has a first length 76 that extends from the structural plate 64 through the tubular void 60 and into the cavity 28. The first length 76 is substantially centered in the tubular void 60 and is substantially perpendicular to the structural plate 64. The illustrated reinforcing rod 66 is formed or shaped so as to also include a second length 78 that extends in the cavity 28 and is substantially perpendicular to the first length 76. The shape of the illustrated reinforcing rod 66 can facilitate the use of the reinforcing rod 66 as a tool for positioning the structural plate 64 along the length of the tubular void 60. The second length 78 can be easily engaged by a user to move the structural plate 64 along the longitudinal axis of the tubular void 60. The second length 78 can also function to limit the distance 68 that the structural plate 64 can be positioned in the tubular void 60. For example, the second length 78 can be configured to contact the outside surface of the end of the flooring section 16 and obstruct further movement of the structural plate 64 into the tubular void 60.

A function of the reinforcing rod 66 is to reinforce or strengthen the poured bonding structure 18. The structural plate 64 provides a base that supports the end of the reinforcing rod 66 to position the reinforcing rod 66 in the tubular void 60 and in the cavity 28. Here, the fit between the structural plate 64 and the tubular void 60 maintains the position of the reinforcing rod 66.

Figure 4:
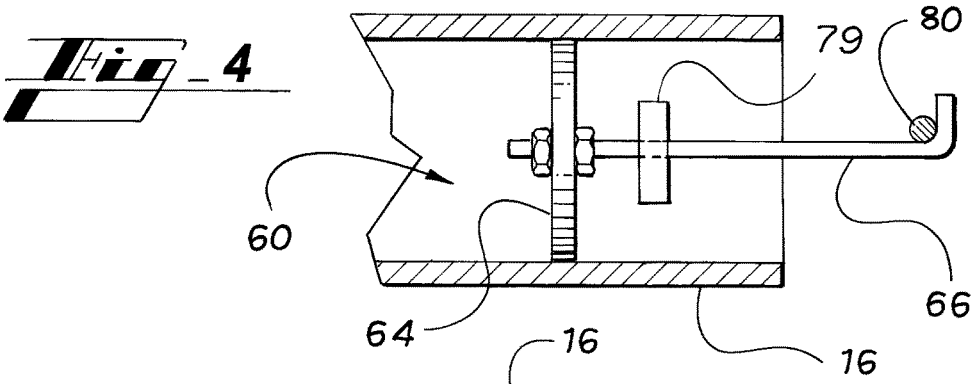
FIGS. 4 and 5 are cross sectional side elevation views of a building structure according to alternative exemplary embodiments.
Figure 5:
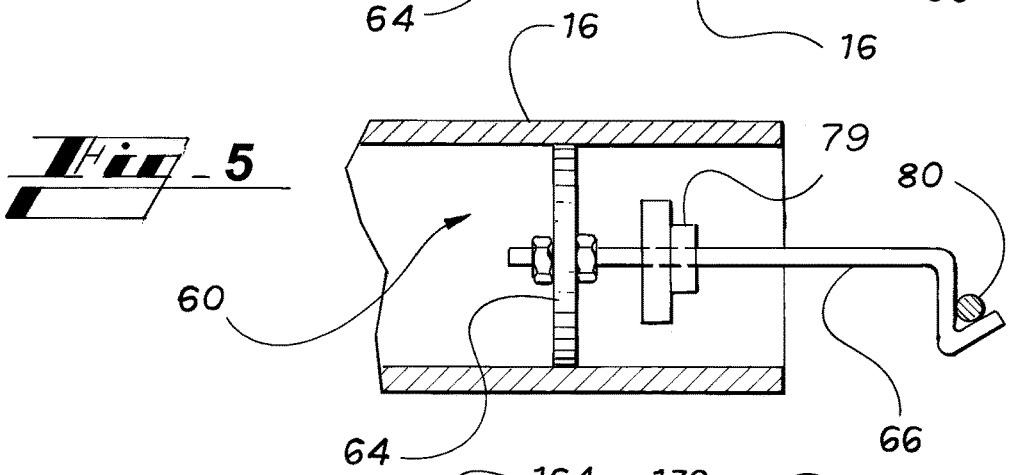
Figure 12:
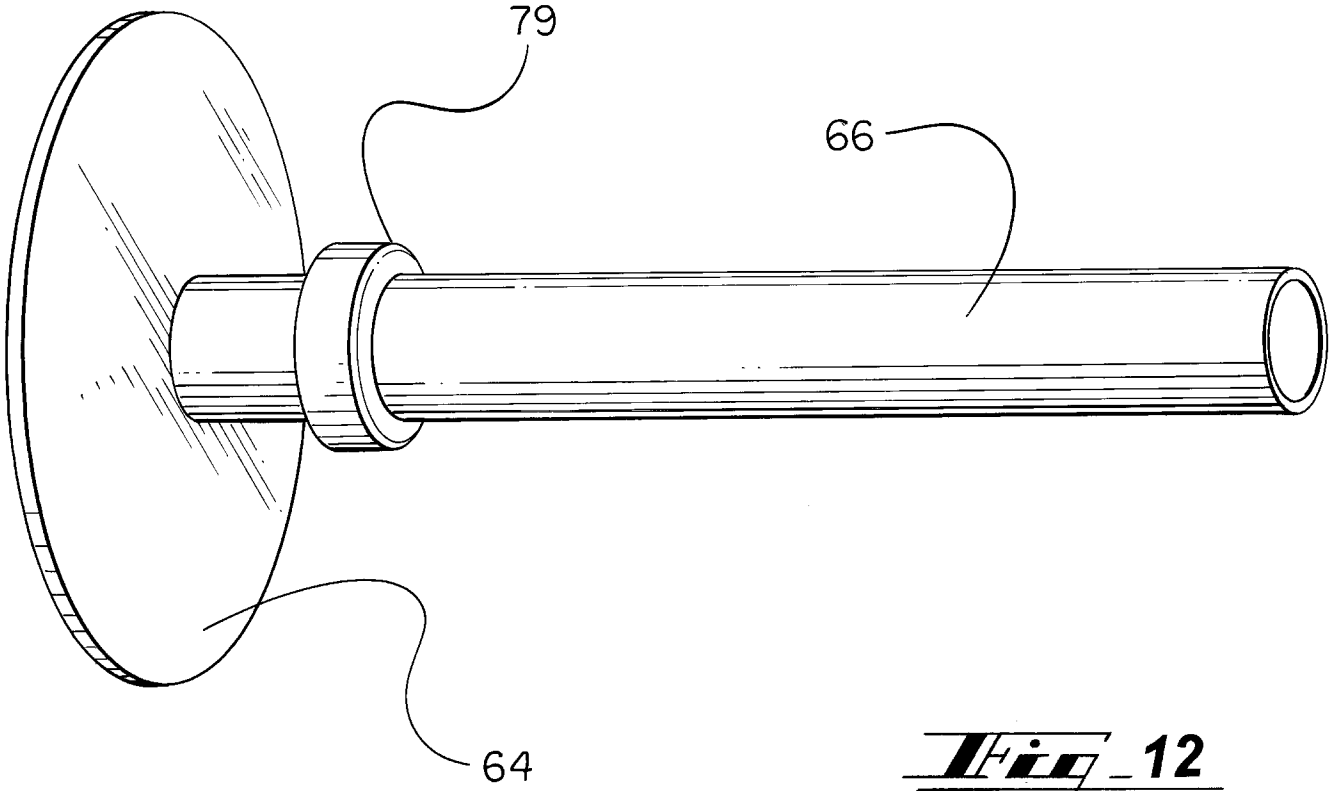
FIG. 12 is a perspective view of an insert according to a fourth exemplary embodiment.

By way of example and not limitation, in alternative embodiments, means for reinforcing can include round bar, rebar, flat bar, any dimensional stock, deformed bar anchors, formed sections of rebar, rebar hooks, ribs, fins, anchor bolts, other anchoring elements, combinations thereof, and the like. Referring momentarily to FIGS. 4, 5, and 12, an exemplary anchoring element 79 is attached or integral to the reinforcing rod 66. Anchoring elements 79 prevent slip of reinforcing rod 66, for example, where the length of reinforcing rod 66 is relatively short.

A function of the illustrated insert 62 is to facilitate positioning lengths of rebar 80 in the cavity 28 of the beam 14 prior to the beam 14 receiving a pourable bonding material 18, such as concrete. The inserts 62 each include a structure that facilitates attaching the lengths of rebar 80 thereto. As illustrated in FIG. 2, the rebar 80 is attached to the second lengths 78 of the inserts 62. The length of the second length 78 can be increased such that additional lengths of rebar 80 can be attached thereto. Further, lengths of rebar 80 can be attached to the portion of the first length 76 that is positioned in the cavity 28. Referring to FIGS. 4 and 5, the reinforcing rods 66 can be configured such that lengths of rebar 80 can rest on the reinforcing rod 66. Means for attaching the lengths of rebar 80 to the inserts 62 can include welds, ties, bending, adhesives, combinations thereof, and the like.

An exemplary method of constructing the building structure 10 is now described. It is contemplated that the building structure 10 can be erected according to alternative methods, for example, by altering the order of the steps of the exemplary method or by adding steps to or omitting steps from the exemplary method. Referring first to FIG. 1, a plurality of columns 12 are erected and a plurality of beams 14 are positioned to extend longitudinally between erected columns 12 such that the cavities 28 of the beams 14 align with the openings 22 of the columns 12. Specifically, the columns 12 are received in the cutouts 36. The ends 38 of adjacent aligned beams 14 abut one another and the abutting ends 38 of the side walls 32*a*, 32*b* of the beams 14 can be attached, such as by bolting or welding, to one another. Thus, abutting beams 14 provide a substantially continuous beam 14 having a base wall 30 that is interrupted by a column 12. It should be noted that the abutting beams 14 are substantially continuous along the side walls 32*a*, 32*b*, the cantilevers 34*a*, 34*b*, and portions of the base walls 30 such that pourable bonding material 18 in the cavities 28 can flow around the exterior of the column 12.

Referring now to FIGS. 1-3, the illustrated flooring sections 16 are set on erected beams 14 such that one end of each of the flooring sections 16 is supported on the support surface provided by a cantilever 34*a* of one beam 14 and the opposite end of each of the flooring sections 16 is supported on the support surface provided by a cantilever 34*b* of another beam 14, with the tubular voids 60 opening to the cavities 28. Since abutting beams 14 provide substantially continuous cantilevers 34*a*, 34*b* or are otherwise not interrupted by the columns 12, the flooring sections 16 can abut one another along side-by-side edges to provide a substantially continuous floor or level, even near the columns 12. In alternative embodiments, only one end or section of a flooring section 16 is supported by a beam 14 while an opposite end is cantilevered over another beam or supported by another shape of beam.

Inserts 62 are inserted into the tubular voids 60. For example, each insert 62 can be gripped by the second length 78 of the reinforcing rod 66 to guide the structural plate 64 into the tubular void 60. As previously mentioned, the position of the structural plate 64 in the tubular void 60 limits the depth that pourable bonding material 18 can flow into the tubular void 60.

Referring again to FIG. 2, lengths of rebar 80 or other reinforcing members, such as post tensioned cables (not shown), extend within the cavity 28, and through the openings 22 in the column 12. The illustrated lengths of rebar 80 are tied or otherwise attached to the inserts 62. Thereby, the lengths of rebar 80 are positioned within the cavities 28 according to a highly efficient method.

Referring next to FIGS. 1 and 3, pourable bonding material 18 such as concrete is poured to first fill the hollow interiors 26 of the columns 12. The pourable bonding material 18 can be directly poured into the hollow interior 26 through the opening 22 or, as the pourable bonding material 18 is poured into the cavity 28, the pourable bonding material 18 is channeled through the opening 22 to fill the hollow interior 26. Once the column 12 is filled up to substantially the height of the base wall 30 of the beam 14, the cavity 28 then continues to fill until the level of pourable bonding material 18 reaches the height to fill the beam 14. The cavity 28 continues to fill until the level of pourable bonding material 18 is substantially coplanar with the top surface of the flooring sections 16 so as to at least partially fill the tubular voids 60. Since the tubular voids 60 are closed with inserts 62, the tubular voids 60 are only filled to a certain depth 68, which reduces the weight of the building structure 10. In alternative embodiments, hollow core columns 12 are exchanged for other column shapes, columns of other materials, and solid columns of other shapes and material.

Pourable bonding material 18 is further poured to define a layer of floor thickness that tops the flooring sections 16. This layer of floor thickness increases the rigidity of the building structure 10. Once the pourable bonding material 18 solidifies, the resulting poured bonding structure 18 integrally connects the beams 14, the columns 12, and the flooring sections 16 to provide the integrated building structure 10.

Figure 7:
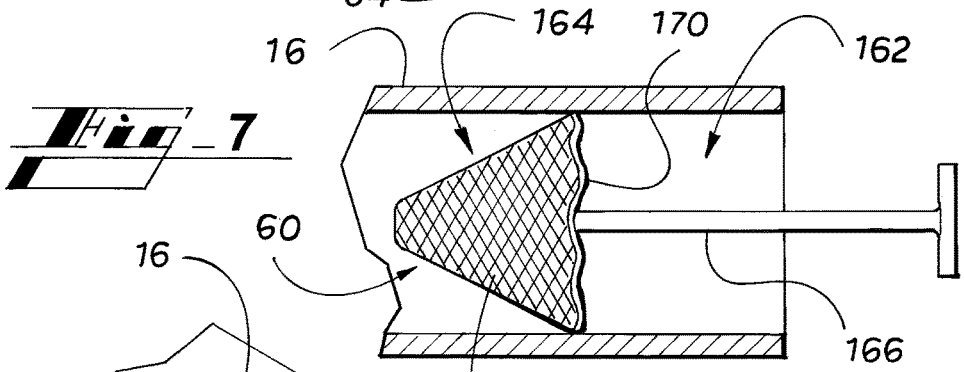
FIGS. 6 and 7 are views of an insert according to a second exemplary embodiment.
Figure 6:
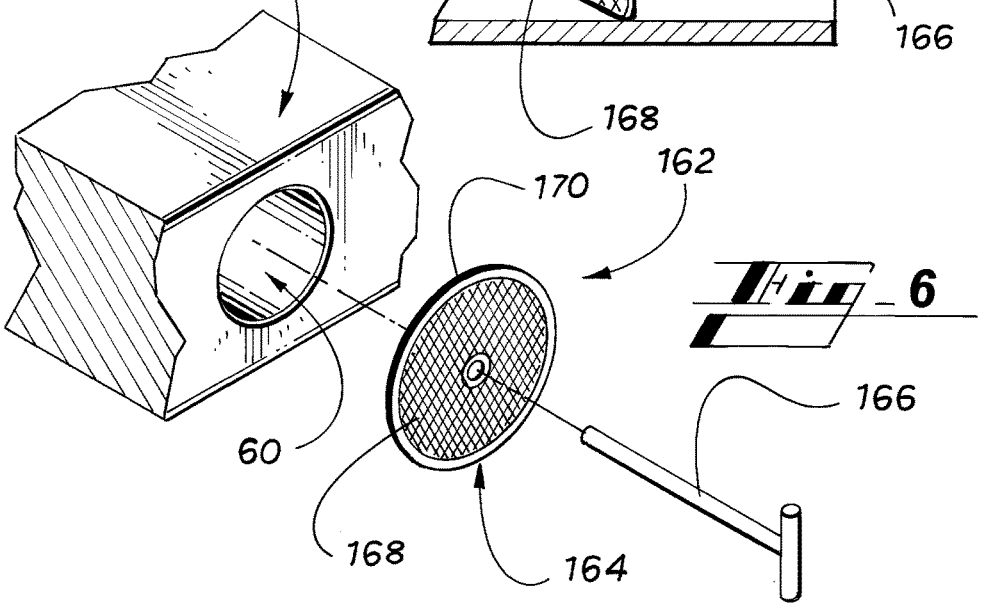

Turning now to FIGS. 6-9, alternative embodiments of inserts are described. Referring to FIGS. 6 and 7, a second embodiment of an insert 162 is illustrated. The insert 162 includes a deformable structure 164 and a handle bar 166. The illustrated deformable structure 164 is configured to limit the flow of pourable bonding material into the tubular void 60 and includes a mesh body 168 with a wire frame 170. The mesh body 168 can be a material such as metal or fabric so long as it is deformable and not so porous as to allow pourable bonding material to flow through it. The handle bar 166 can be connected, for example, to a ring at the center of the mesh body 168.

The illustrated wire frame 170 has a diameter that is greater than the diameter of the tubular void 60. Referring to FIG. 7, as the deformable structure 164 is forced into the tubular void 60 with the handle bar 166, the wire frame 170 is partially collapsed and retained in a collapsed condition by the tubular void 60. The wire frame 170 presses against the inner wall of the tubular void 60 such that the mesh body 168 substantially forms a partition. In the illustrated embodiment, the handle bar 166 is used to position the deformable structure. In certain alternative embodiments where the deformable structure 164 does not support and position the handle bar 166, the insert 162 can include a support structure such as one or more wheels that positions the handle bar 166. In other alternative embodiments, the handle bar 166 is omitted.

Figure 8:
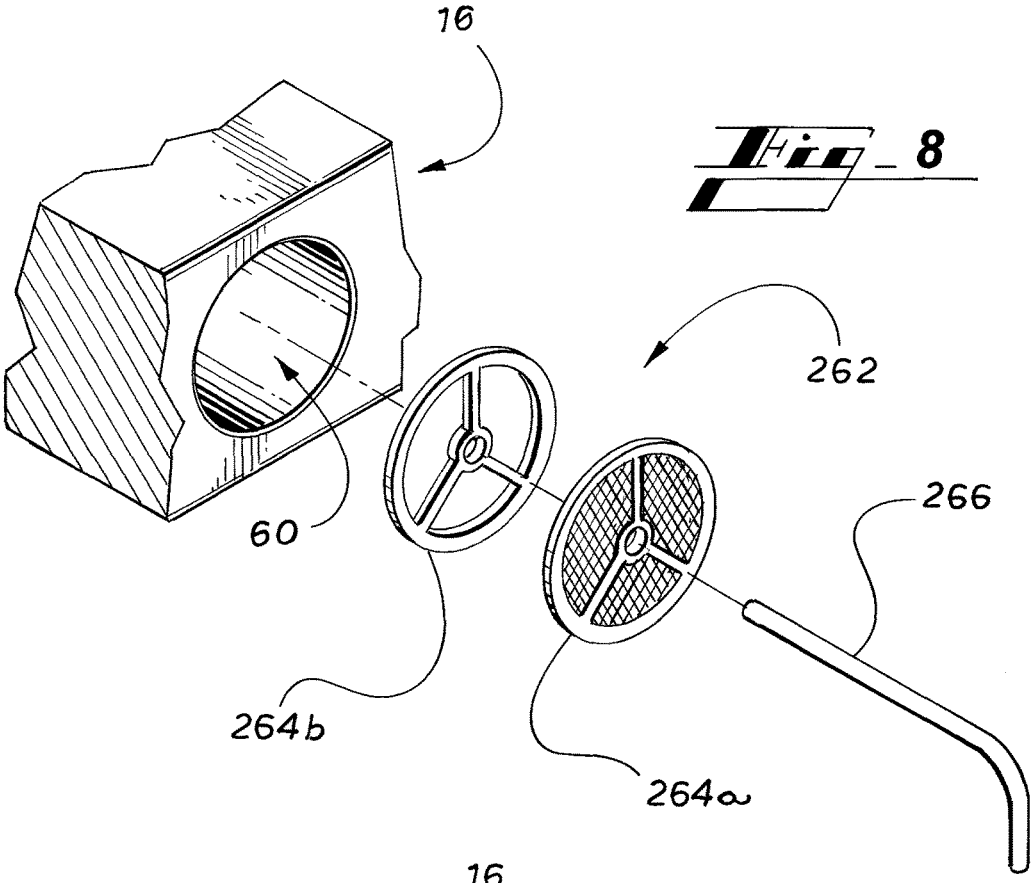
FIGS. 8 and 9 are views of an insert according to a third exemplary embodiment.
Figure 9:
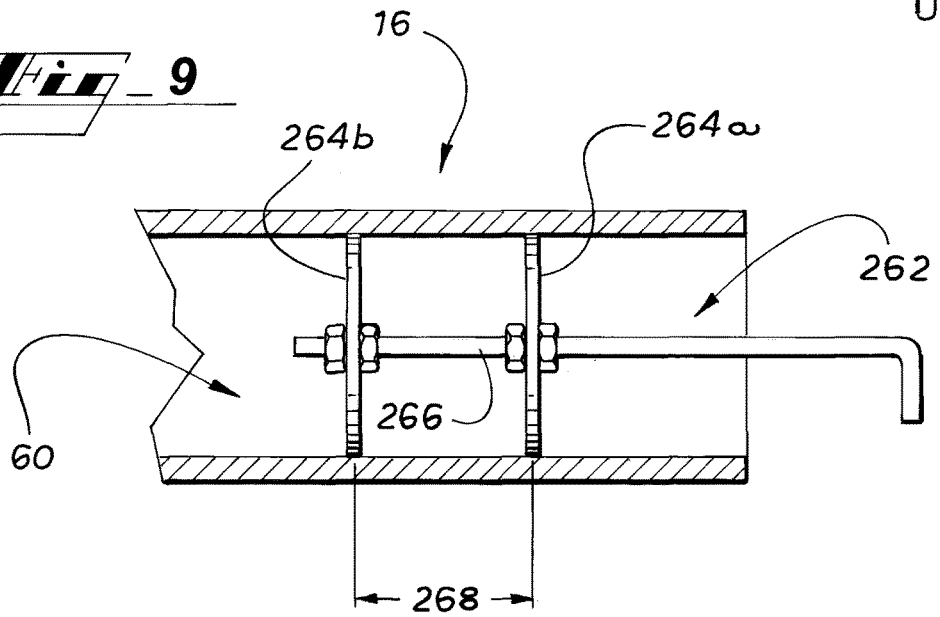

Referring to FIGS. 8 and 9, a third embodiment of an insert 262 is illustrated. The insert 262 includes a pair of wheels 264*a*, 264*b* and a reinforcing rod 266. The wheels 264*a*, 264*b* support and position the reinforcing rod 266 in the tubular void 60. The distance 268 between the wheels 264*a*, 264*b* can be adjusted to increase or decrease the support that is applied to the reinforcing rod 266. Increasing the distance 268 can increase the support and decreasing the distance reduces the profile of the wheels 264*a*, 264*b* along the longitudinal dimension of the tubular void 60. The wheel 264*a* is illustrated as being configured to obstruct the flow of pourable bonding material therethrough. In alternative embodiments, the positions of the wheels 264*a*, 264*b* are switched, which would increase the depth that pourable bonding material 18 is permitted to flow into the tubular void 60.

Figure 10:
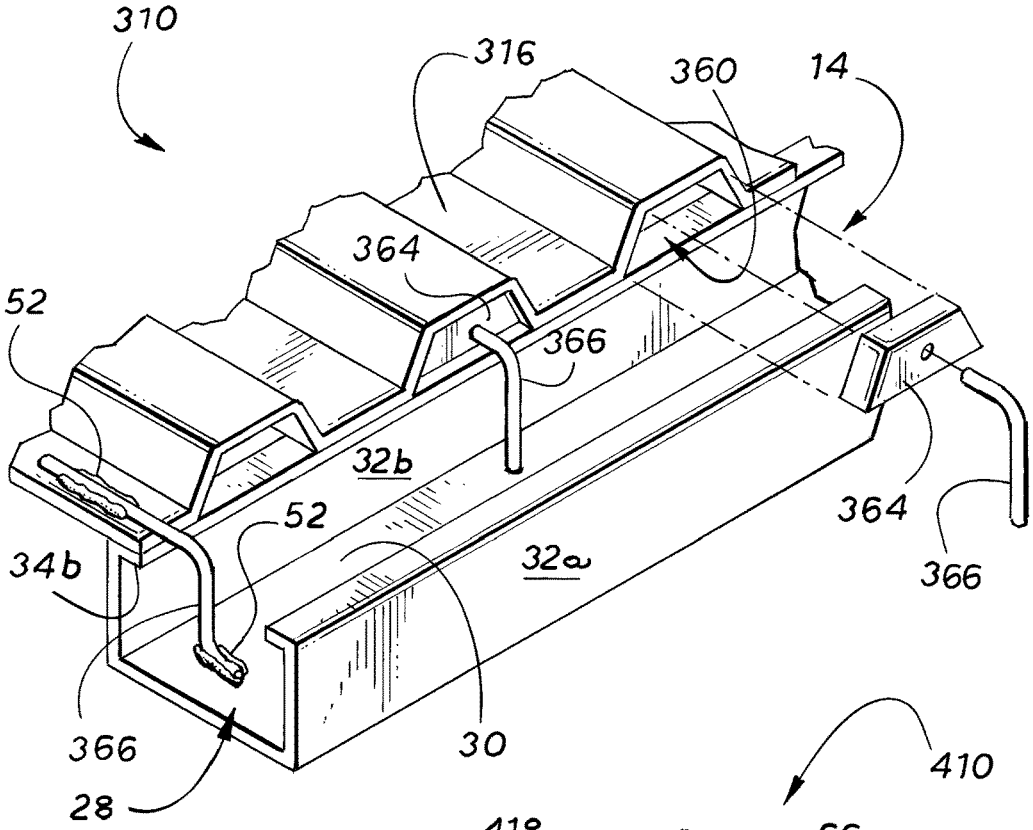
FIGS. 10 and 11 are building structures according to alternative exemplary embodiments.
Figure 11:
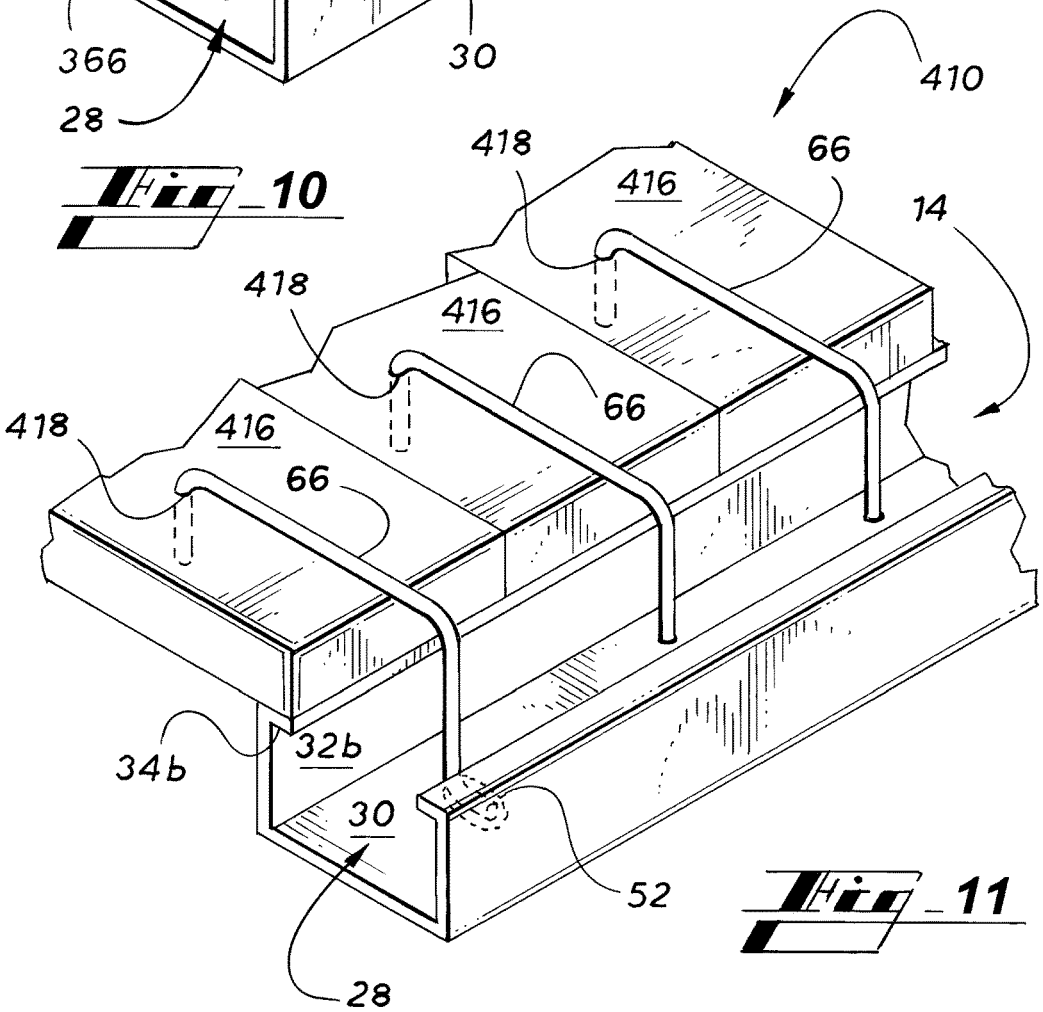

Referring to FIGS. 10 and 11, building structures 310, 410 that include other types of flooring sections 316, 416 are illustrated. Referring to FIG. 10, flooring section 316 is metal decking that includes troughs and raised sections. Insert 364 is positioned in a void 360 between a raised section of the flooring section 316 and the beam 14. The insert 364 can be secured in place. In one embodiment, the insert 364 is secured in place by fillet welds 52. Alternatively, the insert 364 is press fit in the void 360. Reinforcing rod 366 is supported by the insert 364 and extends from the void 360 into the cavity 28 of the beam 14. A pourable bonding structure (not shown) that fills the cavity 28 embeds the portion of the reinforcing rod 66 that is in the cavity 28 to connect the beam 14 to the flooring section 316. In various embodiments, the reinforcing rod 366 is fillet welded 52 to both the flooring section 316, and/or to the beam 14, and/or to the insert 364.

Referring to FIG. 11, flooring sections 416 are wooden beams. The reinforcing rod 66 is inserted through an aperture 418 in the flooring section 416 to attach an end of the reinforcing rod 66 to the flooring section 416. The reinforcing rod 66 extends into the cavity 28 of the beam 14 and connects the flooring section 416 and the beam 14 as a poured bonding structure (not shown) is formed in the cavity 28 and embeds an end of the reinforcing rod 66. In various embodiments, various connections may be used to attach the reinforcing rod 66 to the beam 14 or flooring sections 316, 416, including welding, threaded bolt connections, friction fit, hooked connectors, combinations thereof, and the like The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A building structure, comprising:

a horizontal beam that at least partially defines a cavity;

a flooring section comprising a void, the horizontal beam supporting an end of the flooring section such that the void opens to the cavity; and an insert configured to be at least partially received within the void, the insert comprising:

a first structure configured to close-off a portion of the void and thereby obstruct the flow of pourable material through the void; and a second structure configured to reinforce a poured bonding structure that is formed in the void.

2. The building structure of claim 1, the second structure being embedded in the poured bonding structure.

3. The building structure of claim 1, the second structure being configured to reinforce the poured bonding structure that is formed in the cavity.

4. The building structure of claim 1, wherein the void is a tubular void.

5. The building structure of claim 4, wherein the second structure is a reinforcing rod that extends along the length of the tubular void.

6. The building structure of claim 1, wherein the first structure is configured to support and position the second structure.

7. The building structure of claim 1, wherein the second structure is configured to adjust the position of the first structure in the void.

8. The building structure of claim 1, wherein the first structure comprises a plate.

9. The building structure of claim 1, wherein the second structure comprises a reinforcing rod.

10. The building structure of claim 9, the insert further comprising an anchoring element positioned along the length of the reinforcing rod.

11. The building structure of claim 9, an end of the reinforcing rod being configured to support a length of rebar.

12. The building structure of claim 1, the poured bonding structure being at least partially formed in both the cavity and the void to integrally connect the horizontal beam and the flooring section.

13. The building structure of claim 1, further comprising a column comprising an at least partially hollow interior and an opening to the at least partially hollow interior, wherein the cavity is positioned with respect to the opening such that the cavity, the void, and the at least partially hollow interior define a continuous volume that is configured to receive a pourable material; the poured bonding structure at least partially filling the continuous volume to integrally connect the column, the horizontal beam, and the flooring section.

14. An insert configured to be received in a void of a flooring section, comprising:

a first structure and a reinforcing rod, wherein the first structure is configured to:

close-off a portion of the void and thereby obstruct the flow of a pourable bonding material through the void; and support and position the reinforcing rod such that the reinforcing rod extends along a length of the void through which the pourable bonding material can flow.

15. The insert of claim 14, further comprising an anchoring element positioned along the length of the reinforcing rod.

16. The insert of claim 14, wherein the reinforcing rod is configured to adjust the position of the first structure in the void.

17. The insert of claim 14, wherein the first structure comprises a plate.

18. The insert of claim 14, the first structure comprising a deformable frame and a mesh body.

19. The insert of claim 14, an end of the reinforcing rod being configured to support a length of rebar.

20. A method of forming a building structure, comprising:

erecting a horizontal beam that at least partially defines a cavity;

erecting a flooring section such that an end of the flooring section is supported by the horizontal beam, wherein the flooring section comprises a void that opens to the cavity;

positioning an insert in the void, the insert comprising:

a first structure configured to close-off a portion of the void and thereby obstruct the flow of material through the void; and a second structure configured to reinforce a poured bonding structure that is formed in the void; and at least partially filling the cavity and the void with a pourable bonding material.

* * * * *